United States Patent [19]

Kirjavainen

[11] 4,414,062

[45] Nov. 8, 1983

[54] HEADBOX OF A PAPER MACHINE

[75] Inventor: Alvi Kirjavainen, Jyväskylä, Finland

[73] Assignee: Valmet OY, Finland

[21] Appl. No.: 322,587

[22] Filed: Nov. 18, 1981

[51] Int. Cl.[3] ..... D21F 1/06

[52] U.S. Cl. ..... 162/336; 162/340; 162/343; 162/347

[58] Field of Search ..... 162/336, 340, 343, 347

[56] References Cited

U.S. PATENT DOCUMENTS

| | | | |
|---|---|---|---|
| 3,098,787 | 7/1963 | Siebert | 162/343 |
| 3,385,754 | 5/1968 | Burgess, Jr. | 162/336 |
| 3,853,697 | 12/1974 | Parker | 162/343 |
| 3,945,882 | 3/1976 | Egelhof et al. | 162/340 |
| 4,202,724 | 5/1980 | Kirjavainen | 162/340 |

FOREIGN PATENT DOCUMENTS

| | | | |
|---|---|---|---|
| 2852564 | 6/1979 | Fed. Rep. of Germany | 162/343 |

*Primary Examiner*—Peter Chin
*Attorney, Agent, or Firm*—Steinberg & Raskin

[57] ABSTRACT

A headbox of a paper machine has a stock distribution header part, a distribution pipe assembly connected to the stock distribution header part, an equalizing passage following the distribution pipe assembly in the flow path of the stock suspension, an air tank in immediate communication with the equalizing passage and a converging slice part following the equalizing passage, the converging slice part having a lower lip wall and an adjustable upper lip wall. A turbulence section between the equalizing passage and the converging slice part has at least one exchangeable grating cassette consisting of at least two grating plates in abutment with each other. A first of the grating plates and in the direction of the stock flow and has a plurality of apertures formed therethrough.

8 Claims, 10 Drawing Figures

HEADBOX OF A PAPER MACHINE

BACKGROUND OF THE INVENTION

The present invention relates to the headbox of a paper machine. More particularly, the invention relates to a headbox which comprises a stock distribution header part connected to an assembly of distribution pipes followed in the flow path of the stock suspension by an equalizing passage. The equalizing passage is most appropriately in immediate communication with an air tank. A turbulence section follows the equalizing passage and a converging slice part follows the turbulence section. The converging slice part has a lower lip wall and an adjustble upper lip wall.

U.S. Pat. No. 3,791,918 of the inventor discloses a headbox structure which comprises a stock distribution header and a distribution pipe assembly followed by a so-called middle chamber. This is followed further by a partitioned flow channel part and finally by a converging slice section. In the aforedescribed patent, the flow channel part comprises several parallel vanes, spaced apart and inclined with reference to the vertical direction, defining between themselves turbulence flow channels which have a cross-section of a parallelogram.

The headbox design disclosed in the aforedescribed patent has proved to be advantageous, but it has a disadvantage, which is the high cost of construction, particularly of the flow vane channel part. Another disadvantage is that the headbox has a fixed construction, so that it is impossible in paper machines which are provided with this type of headbox to vary substantially the grade of paper to be produced. It is also impossible to accurately adjust the headbox characteristics to correspond to the requirements of the stock type used or the paper quality to be produced.

In Finnish patent application Nos. 800018 and 801167 of the inventor, some headbox solutions utilizing cassette construction are described. The object of the solution is expressly that those parts which confine the flow channel in the headbox are exchangeable cassette-like sections, so that the headbox may be composed of replaceable components. It is thus relatively easy to change the headbox construction in case the type of production is changed. Such a structure also facilitates the cleaning of the interior of the headbox and its overall maintenance, compared with conventional constructions.

The features of the headbox of the invention are also applicable to headboxes for the production of multilayer paper grades. In this respect, reference is made, for example, to Finnish patent application No. 801587 of the inventor. This patent application discloses a headbox for a paper machine producing multilayer paper grades, in which headbox there are two or more separate flow channels for stock suspensions. The flow channels join in the slice region of the headbox, and each comprises a distribution header, a distribution pipe assembly part, or its equivalent, and further equalizing and turbulence sections for stock flow. One rigid grating plate member is provided between the flow equalizing section and the turbulence section. The rigid grating plate member is provided with several series of flow apertures. The turbulence section constitutes several parallel plate vanes, or their equivalent, fixed in position, principally at their front ends, in the grating plate part. One or more middle plates, extending right up to the slice region of the headbox, are provided between the horizontal series of plate vanes.

SUMMARY OF THE INVENTION

The principal object of the invention is to provide a headbox construction which retains the good functional features of the headbox disclosed in the aforedescribed U.S. Pat. No. 3,791,918, which headbox construction is, however, simpler in structure and less expensive in manufacture.

An object of the invention is to provide a headbox having a construction in which, at least to a certain extent, cassette-type structural components are used which are exchangeable and replaceable by spare parts, for example, in connection with wire change, if the grade and quality of the paper or board to be produced or the speed of the paper machine have to be varied.

Another object of the invention is to provide a headbox in which the structure of the lower lip comprises a uniform lower headbox body part in which the vane section may be replaced by structures which are less expensive and may be easily changed to correspond to the requirements of the paper machine production.

Still another object of the invention is to provide a headbox construction in which the shifting slide of the upper lip beam of the headbox, with its planes and fastenings, may be omitted and the corresponding function may be compensated by a simpler construction arranged in connection with the air tank of the headbox.

In order to attain the stated objectives, as hereinafter explained in more detail, the headbox of the invention is primarily characterized in that the turbulence section consists of at least two grating plates in abutment with each other, a first of the grating plates in the direction of the stock flow having a plurality of apertures formed therethrough.

In the headbox of the invention, the final control and adjustment of the stock flow is accomplished via one or more successive plate cassettes, of grating or hole plate type, designed to replace the vane flow channel section of the prior art. The cassettes may be exchangeable, so that different "spare parts" may be used. The distribution pipe assembly is also a cassette and is replaceable in order to obtain the desired turbulence, in case the paper quality or machine speed is changed. In headboxes for large flow volumes such as, for example, kraft paper grades, it is advantageous to use cassettes having crosswise gratings. Such cassettes produce an efficient flow resistance, which disperses fiber bundles and creates turbulence, in the same manner as holed rollers.

Tilting of the upper lip body and its horizontal movement may be accomplished in a simple manner, in connection with the air cushion construction, to replace the so-called shifting slide of the prior art. The lower lip part may be provided as a simple and inexpensive lower body which replaces the lower structure of the headbox. The forces acting on the headbox may be managed from the side of the distribution header by the distribution pipe cassette and managed from the front of said header by the grating plate cassette. The forces which act on the upper lip and on the air cushion nearly balance each other.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
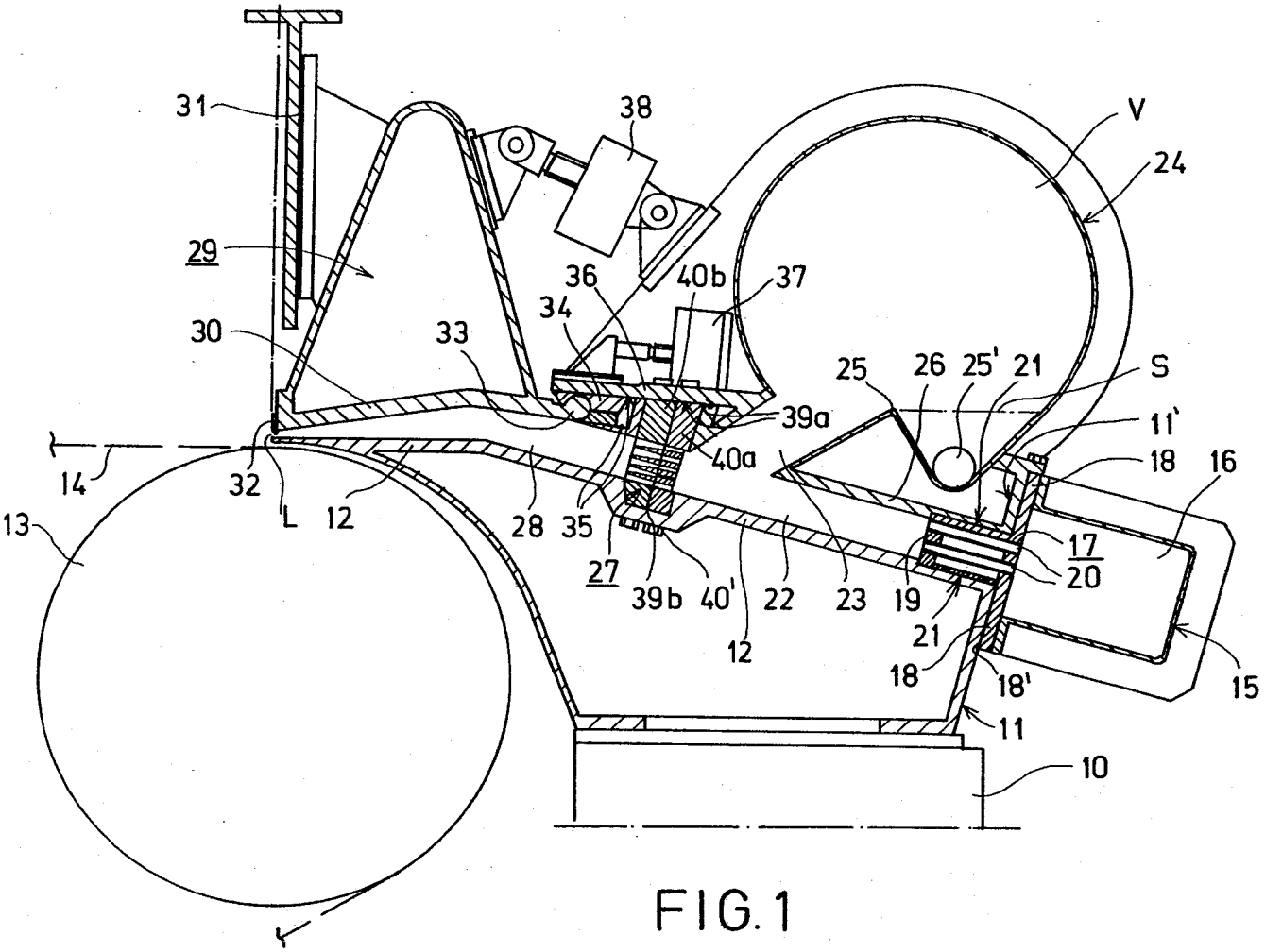
FIG. 1 is a longitudinal elevation, partly in section, of an embodiment of the headbox of the invention.
Figure 2:
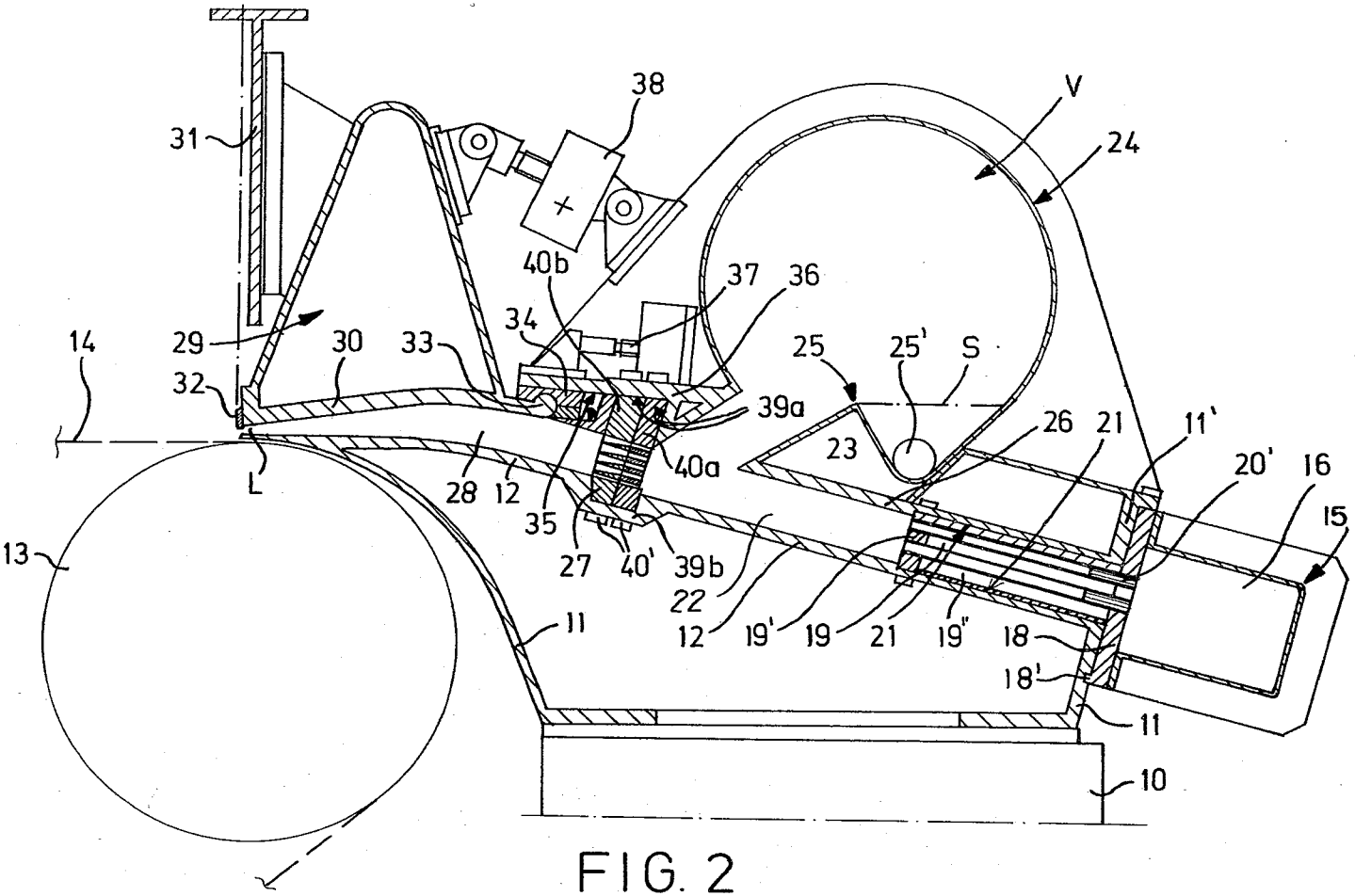
FIG. 2 is a longitudinal section, partly in section, of another embodiment of the headbox of the invention.

The headbox shown in FIGS. 1 and 2 is supported by a base structure 10. The headbox comprises a lower lip beam 11 having a uniform continuous upper wall or surface 12. A stock suspension jet is delivered through a slice opening L onto a view 14, travelling around a breast roller 13. A stock suspension flow enters the headbox from a flow channel 16 of a distribution header 15 which is located transversally to the direction of the stock flow in other sections of the headbox proper. The distribution header 15 is followed by a distribution pipe assembly 17, 19 which constitutes an exchangeable cassette unit, as hereinafter explained. The distribution pipe assembly 17, 19 is followed by an equalizing section 22. The equalizing section 22 communicates directly with an air tank 24 via a channel 23 which extends over the whole width of the headbox. The tank 24 confines an air space or air cushion V above the stock level. The air space or air cushion V damps pressure pulsations occurring in the stock suspension flow, in a known manner. An overflow baffle 25 is provided in the channel 23 for determining the level S of the stock suspension in the air tank 24. A drain pipe 25' for overflow is provided beneath the baffle 25.

In accordance with the invention, the vane channel section of the prior art, which operates as turbulence generator, is replaced by a grating cassette section 27. The grating cassette 27 has a plurality of appropriately formed flow apertures formed therethrough in rows, or side-by-side, and/or in columns, or one on top of another.

As shown in FIGS. 1 and 2, the grating cassette section 27 comprises two grating plates **40*a* and 40*b* which are mounted in abutment with each other, or side-by-side successively with regard to the stock flow direction. The grating plates 40*a* and 40*b* are provided with apertures facing each other and the plate 40*b* also has tail members. The grating plates 40*a* and 40*b* are affixed, via screws 40' in grooves 39*a* and 39*b* on the upper and lower sides, respectively, of the stock flow channel. The lower groove 39*b* is formed in the continuous, and otherwise plain, upper wall 12 of the lower lip beam 11 of the headbox. The upper groove 39*a* is adjacent a beam 36 of the structure which also supports the air tank 24**.

In a preferred embodiment of the invention, a shifting slide member 34 of an upper lip beam 29 is also mounted on the beam 36. For this purpose, the front part of the beam or frame structure 36 has a slide groove 35 formed therein for accommodating the shifting slide member 34 of the upper lip beam 29. A pivot device 33 is connected to the shifting slide member 34. The pivot device 33 is located at the rear edge of the upper lip wall 30 and the upper lip beam 29 may be turned about the pivot point of the pivot device 33 via a known device 38.

The upper lip body 29 has a front wall beam 31 provided with adjusting spindles known in the art for adjusting an edge strip 32 of the slice opening. The shifting slide 34 is arranged to be moved by a worm gear 37, for example. The worm gear 37 is known in the art. One part of the worm gear 37 is attached to the beam 36 and is further coupled to the shifting slide 34.

The cassette 17, 19 of FIGS. 1 and 2, constituting the distribution pipe assembly, consists, first, of a holed plate member 18 which constitutes the front wall of the distribution header 15. The holed plate member 18 is joined tightly to the lower lip body 11 and to the support structure 11' of the air tank 24. A notch and shoulder arrangement 18' may be utilized to affix the holed plate member 18 to the structures 11 and 11'. The distribution pipe cassette 17, 19 consists of a plurality of pipes 20 assembled and fixed between the holed plate member 18 and a second holed plate member 19, 19'.

The length of the distribution pipes 20 is most properly 5 to 10 times the diameter of said pipes.

The distribution cassette 19, shown in FIG. 2, consists of a pipe assembly proper 19'' comprising two or more rows of pipes, one upon another. Special sleeve parts 20' maintain the pipes of the pipe assembly 19'' in connection with the first holed plate member 18. The rear ends of the pipes, in the flow direction, are affixed to the second holed plate member 19'.

The distribution pipe cassette unit 17, 19 is assembled between a plane 21 in an upper wall 26 and a plane 21' in the lower wall 12 of the flow channel of the headbox.

In accordance with the invention, the distribution pipe cassette unit 17, 19 and the grating plate cassette 27 are exchangeable components which may be replaced relatively easily and rapidly in connection with a wire change in the paper machine, for example, or in case of a change of the paper grade being produced or the speed of the paper machine, for example. Since these components are exchangeable, the cleaning thereof, as well as the cleaning of the whole headbox is more easily undertaken than previously.

Figure 3:
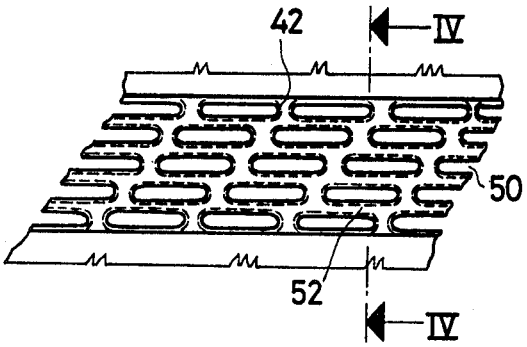
FIG. 3 is a view, on an enlarged scale, of a first embodiment of part of the grating cassette of the headbox of the invention.
Figure 4:
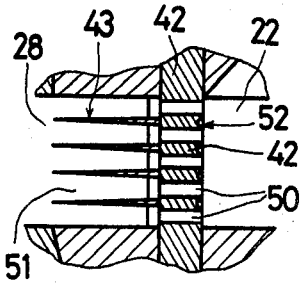
FIG. 4 is a transverse sectional view, taken along the lines IV—IV, of FIG. 3.

FIGS. 3 and 4 show a grating plate assembly 42 in which the flow aperture pattern is defined by horizontally oblong openings 50 grouped in a plurality of horizontal rows and arranged obliquely one upon another, in such a manner that the open flow area is substantially the same in any vertical cross-section of the said plate. This arrangement of the flow apertures and their shape in the grating plate 42 creates a special flow pattern in the stock suspension, which results in an effective turbulence and contributes to an even sheet formation.

A special feature of the grating plate cassette 42, shown in FIGS. 3 and 4, is also that lands 52 between apertures 50, in the front side with regard to the stock flow direction, are provided with grooves having round bottoms 52. The purpose of the round bottoms of the grooves is to keep the front surface of the grating plate 42 clean. As the stock suspension bumps against the lands 52 and grooves between the apertures 50, a certain turbulence is created which effectively disperses fiber lumps in the stock suspension and also prevents the formation of fiber and filler depositions on the land surfaces between said apertures. This therefore eliminates, or at least appreciably reduces, problems which arise when conventional grating plates are used. Such problems are those caused by the formation of fiber lumps and/or filler material deposits on the grating plate surfaces.

The plate 42 of FIGS. 3 and 4 is followed by one having an equal number of apertures, but apertures of greater area than those of the first plate. In addition, the lands between the apertures of the second grating plate are provided with tails or veins 43 constituting a foil system across the entire width of the headbox.

Figure 5:
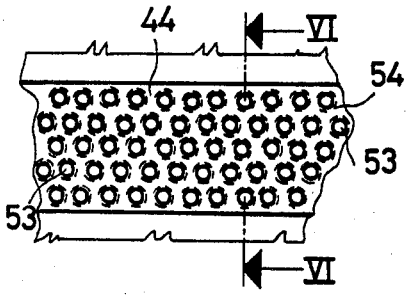
FIG. 5 is a view, on an enlarged scale, of a second embodiment of part of the holed grating cassette of the headbox of the invention.
Figure 6:
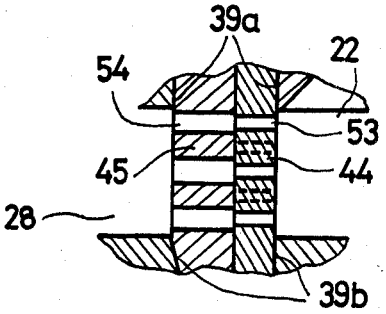
FIG. 6 is a transverse sectional view, taken along the lines VI—VI, of FIG. 5.
Figure 7:
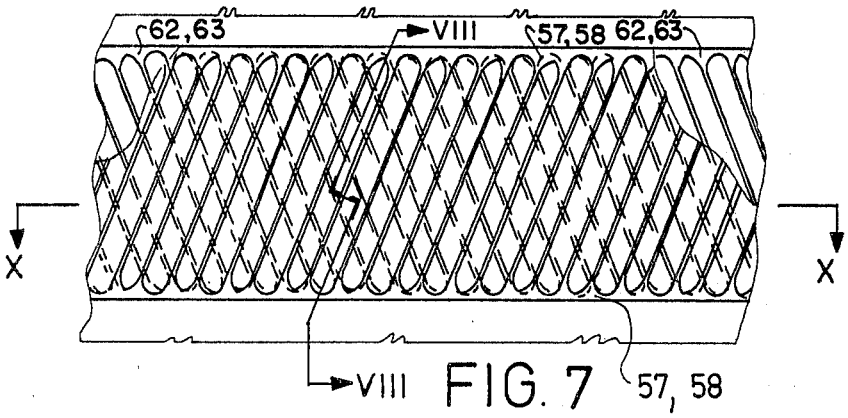
FIG. 7 is a view, on an enlarged scale, of a third embodiment of part of the grating cassette of the headbox of the invention, consisting of two grating plates.
Figure 8:
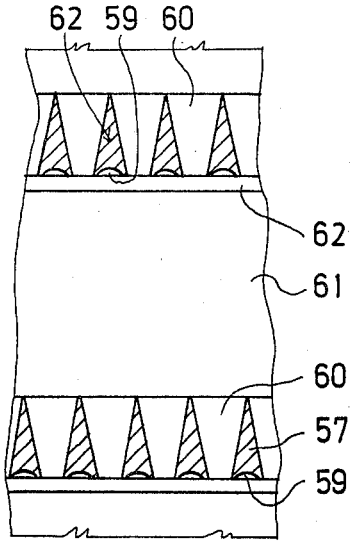
FIG. 8 is a sectional view, taken along the lines VIII—VIII, of FIG. 7.
Figure 9:
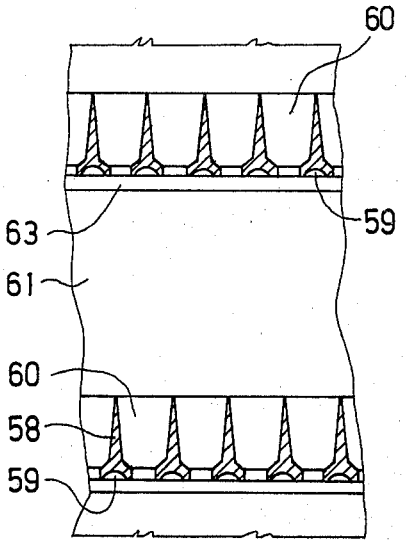
FIG. 9 is an alternative sectional view, taken along the lines VIII—VIII, of FIG. 7.
Figure 10:
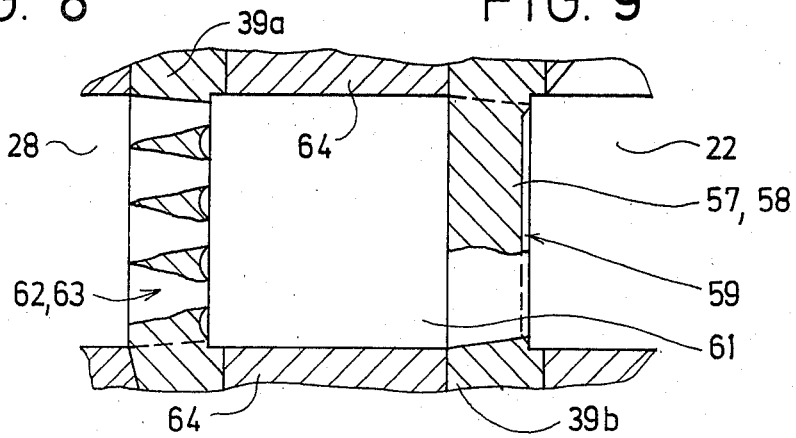
FIG. 10 is a sectional view, taken along the lines X—X, of FIG. 7.

In the embodiment of FIGS. 5 and 6, the flow pattern of the stock suspension is influenced by two successive holed plates 44 and 45, which are provided with concentric round holes 53 and 54, so that the total hole area is about 40% in the first plate 44 in the flow direction and 75% in the second plate 45. The second holed plate 45 achieves a proper degree of turbulence and a decrease in the stock flow velocity, due to its greater total hole area.

The embodiment of FIGS. 7, 8, 9 and 10 is intended primarily for the production of kraft paper grades. The grating cassette of this embodiment has a pair of grating plates 57, 58 and 62, 63 with crosswise gratings. More than two grating plates may be used in succession, if necessary, for equalizing the stock suspension flow or for improving the sheet formation. A characteristic feature of the embodiment of FIGS. 7 to 10 is that apertures 60 of the grating plates are oblong and extend obliquely with respect to the vertical direction. Another feature is that the apertures 60 extend from the bottom to the top of the flow channel. Still another feature is that the flow apertures of the second grating plate 62, 63 are at an opposite angle with the apertures 60 of the first grating plate 57, 58. The stock suspension flowing through the first grating plate 57, 58 bumps against the lands of the second grating plate 62, 63. The lands of the second grating plate 62, 63 are provided with grooves having rounded bottoms, as in the embodiment of FIGS. 3 and 4. These rounded bottoms create an effective turbulence which causes a shear in the stock suspension flow. The shear disperses fiber bundles and simultaneously effectively equalizes the flow profile of the stock suspension in the cross-direction of the flow channel. The forces caused by the skew of the flow apertures of the first grating plate and the lands between them influencing the stock flow profile are compensated by the second grating plate having an opposite skew. The first and second grating plates 57, 58 and 62, 63, respectively, are spaced from each other by a distance determined by spacers 64.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a headbox of a paper machine having a stock distribution header part; a distribution pipe assembly following and communicating with said stock distribution header part in the direction of the stock flow; and a stock suspension flow passage downstream of and following said distribution pipe assembly having upper and lower wall means and including means defining an equalizing passage communicating with and following said distribution pipe assembly in the flow path of the stock suspension with an air tank in direct communication with said equalizing passage for damping pressure pulsations occurring in the stock flow, a turbulence section downstream of and communicating with said equalizing passage, and a converging slice part communicating with and following said equalizing passage in the direction of stock flow, said converging slice part having a lower lip wall and an upper lip wall, and wherein at least said turbulence section is constituted by at least one exchangeable grating cassette component removably attached to the headbox, the improvement comprising:

said turbulence section includes two grating plates situated against each other extending transverse to the direction of stock flow, the first of the two plates having a plurality of first bores formed therethrough and the second of the two plates having a corresponding plurality of second bores formed therethrough, each of said second bores being coaxial with a respective one of said first bores and having a larger diameter than that of said respective first bore to form a step therebetween, and wherein said grating plates constitute mechanical supporting and load-bearing means between said upper and lower wall means of said stock suspension flow passage for taking up forces acting on said upper and lower wall means of said stock suspension flow passage.

2. A headbox as claimed in claim 1, wherein the distribution pipe assembly comprises exchangeable cassette components removably coupled to the headbox, said cassette components including at least one aperatured plate and a plurality of pipes.

3. A headbox as claimed in claim 1, wherein said first grating plate of said turbulence section in the stock flow direction has a plurality of rounded bottom grooves formed in lands situated between said bores.

4. A headbox as claimed in claim 1 wherein a last of said grating plates in the flow direction includes a plurality of vanes extending forwardly thereof and transverse to the direction of stock flow, said vanes tapering in the direction of stock flow.

5. A headbox as claimed in claim 2 further comprising frame means for supporting the headbox including a lip beam and wherein said exchangeable cassette components of said distribution pipe assembly include a plurality of parallel distribution pipes situated in side-by-side relationship in columns and rows with respect to each other, said distribution pipes having front and rear ends in the direction of stock flow, a first apertured plate adjoining a said lip beam of said frame means and to which said front ends of said distribution pipes are connected so as to communicate with the apertures thereof, and a second apertured plate removably affixed in said headbox to which said rear ends of said distribution pipes are connected so as to communicate with the apertures thereof.

6. A headbox as claimed in claim 2 further including a supporting frame structure having spaced opposed planar wall members, and wherein said exchangeable cassette components of said distribution pipe assembly include upper and lower wall members which respectively abut said opposed planar wall members of said supporting frame structure.

7. A headbox as claimed in claim 1 wherein said lower lip wall of said converging slice part has a first groove formed therein extending transversely to the direction of stock flow and wherein said headbox includes frame means for supporting said headbox, said frame means having a second groove extending transversely to the direction of stock flow, and wherein said grating plates of said turbulence section have lower end regions removably affixed in said first groove and upper end regions removably affixed in said second groove.

8. A headbox as claimed in claim 7 wherein said frame means in which said second groove is formed is connected to said air tank, said frame means further including a forward part having a slide groove formed therein, and further including a shifting slide member of said upper lip wall for adjustably mounting said upper lip wall of said slice part on said slide groove of said frame means, and force means for adjustably displacing said upper lip wall in a substantially horizontal direction for adjusting said slice part.

* * * * *